United States Patent [19]

Lewis

[11] 4,112,861

[45] Sep. 12, 1978

[54] MAST STEPPING AND UNSTEPPING STRUCTURE

[76] Inventor: Barry R. Lewis, 1005 Orange Ave., Sarasota, Fla. 33577

[21] Appl. No.: 839,105

[22] Filed: Sep. 30, 1977

[51] Int. Cl.[2] ..... B63B 15/00

[52] U.S. Cl. ..... 114/91; 114/39

[58] Field of Search ..... 114/39, 89, 90, 91, 114/94, 97, 98, 100, 102, 111

[56] References Cited

U.S. PATENT DOCUMENTS

| | | | |
|---|---|---|---|
| 3,768,426 | 10/1973 | Kratz | 114/90 |
| 3,827,386 | 8/1974 | Faden | 114/91 |

*Primary Examiner*—Trygve M. Blix
*Assistant Examiner*—D. W. Keen
*Attorney, Agent, or Firm*—Clarence A. O'Brien; Harvey B. Jacobson

[57] ABSTRACT

A sailboat hull is provided including an upright mast having upper and lower end portions. First structure pivotally supports the lower end of the lower end portion of the mast from the hull for swinging between an upright position and a lowered position with the upper end of the lower end portion swung toward one end of the hull. Second structure pivotally supports the lower end of the upper end portion from the upper end of the lower end portion for swinging between an upright position and a lowered position with the upper end of the upper end portion swung toward the other end of the hull. Third structure is operatively connected between the upper and lower end portions of the mast and the hull operative for sequentially controllably lowering the lower end portion from its upright position to its lowered position while maintaining the upper end portion upright and thereafter controllably lowering the upper end portion from its upright position to its lowered position and for sequentially controllably raising the upper end portion from its lowered position to an upright position and thereafter controllably raising the lower end portion from its lowered position to its upright position while maintaining the upper end portion of the mast upright.

10 Claims, 10 Drawing Figures

Fig. 1
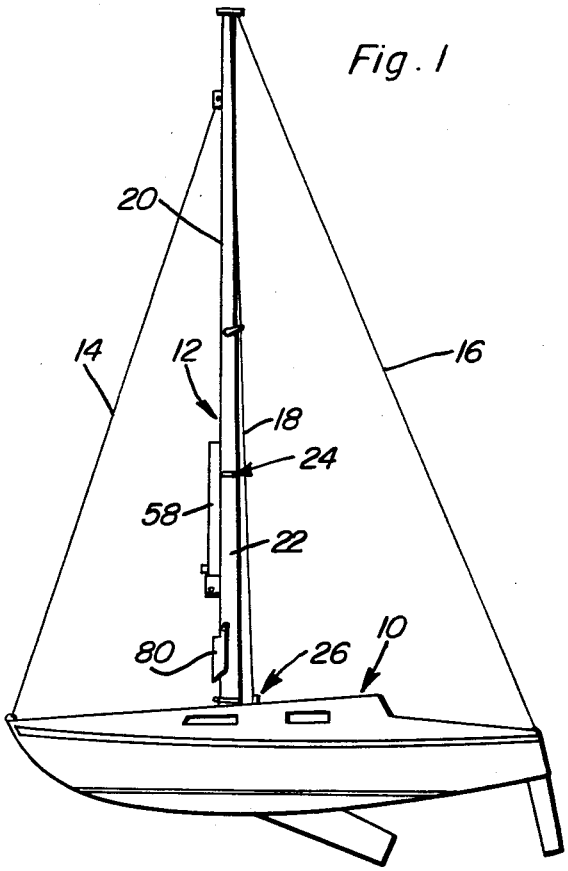
Fig. 2
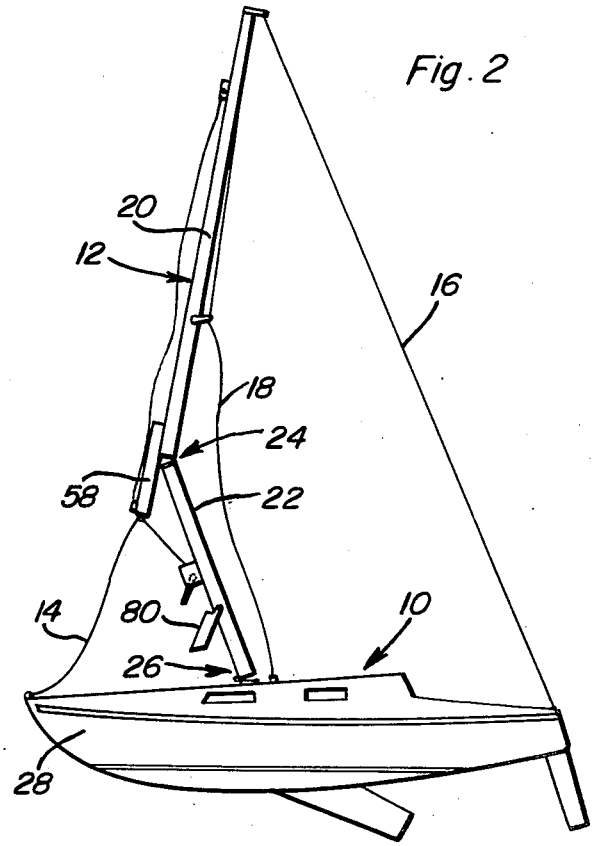
Fig. 7
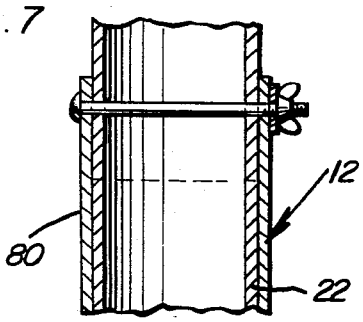
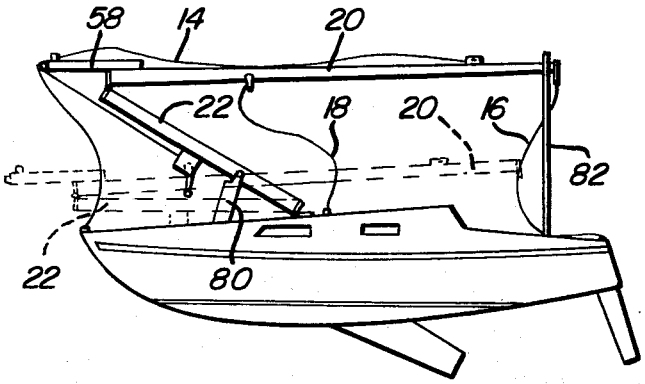
Fig. 3

MAST STEPPING AND UNSTEPPING STRUCTURE

BACKGROUND OF THE INVENTION

In recent years there has been a considerable growth in the popularity of trailerable cruising sailboats. These sailboats typically have shallow or retractable keels and can be trailered as easily as a power boat. However, a sailboat may not be trailered with its mast in an upright position and it usually requires at least two people to unstep a mast of a cruising sailboat in order that the same may be trailered. In addition, in order to unstep the mast of a cruising sailboat, it is necessary to disconnect the forestay of the mast and to loosen the shrouds. Of course, in order to step a mast of a cruising sailboat, it also requires two people and the forestay must be attached and the shrouds must be tuned or adjusted. The stepping and unstepping of the mast of a sailboat and the attaching and unattaching of the forestay as well as the adjustment or tuning of the shrouds of the mast is time consuming. Further, the stepping and unstepping of a conventional mast requires at least average strength on the part of the two people attempting to unstep or step a mast. Therefore, few cruising sailboats are trailered to and from the water on each day of their use, even though trailering a sailboat to and from the water substantially eliminates the necessity of hull bottom maintenance which is very time consuming each year, if the sailboat is left in the water for the entire sailing season.

In addition, sailboats of the cruising type and provided with conventional masts which may be stepped and unstepped cannot have the masts thereof readily and quickly unstepped and thereafter readily and quickly stepped as may be desired in order to pass beneath a low bridge.

Yet another problem resulting from crusing sailboats whose masts may not be readily unstepped and stepped arises in locating boat storage space at the point of use if the sailboat is not to be trailered to and from its point of use. The phenomenal growth in boating popularity has made "in the water" storage very difficult to find and premium rental must be paid for slip space if slip space can be found. Although motor boats may be stored by the "high rise storage" method where power boats are stacked in racks by forklift trucks and may be readily unstacked and launched by forklift trucks whenever desired, it is obvious that cruising sailboats with their masts stepped may not benefit from such "high rise storage".

Accordingly, a need exists for a sailboat mast construction which may be readily unstepped and stepped whenever desired in a matter of a few minutes and by only one person.

While various forms of improved mast stepping and unstepping structures as well as similar articulated joints have been heretofore designed, such as those disclosed in U.S. Pat. Nos. 270,358, 457,323, 477,477 and 3,827,386, these various masts stepping and unstepping structures do not provide a total solution to any of the above noted problems which are encountered by the owners of sailboats whose masts may not be readily unstepped and stepped.

BRIEF DESCRIPTION OF THE INVENTION

The mast stepping and unstepping structure of the instant invention utilizes a two-piece mast with the upper and lower sections of the masts pivotally joined together and the lower end of lower section of the mast pivotally supported from the associated hull. The relative lengths of the mast sections are so selected whereby either the fore or aft stay of the mast is utilized in conjunction with a winch mechanism connected between the upper and lower mast sections for controllably swinging the lower section of the mast in one direction along the associated hull while maintaining the upper section of the mast upright and for thereafter controllably swinging the upper end section of the mast toward the other end of the hull in order to accomplish a mast unstepping operation. Further, the process of stepping the mast is accomplished in the reverse order.

The main object of this invention is to provide a mast structure which may be readily unstepped and stepped.

Still another object of this invention is to provide a mast structure which may be unstepped and stepped in a matter of a few minutes.

Yet another object of this invention is to provide a mast structure which may be stepped and unstepped by a single person.

A further very important object of this invention is to provide a mast which may be readily stepped and unstepped without requiring that the stays and shrouds be tuned each time the mast is stepped.

A still further object of this invention is to provide a mast structure which may be readily stepped and unstepped and which may be incorporated into the manufacture of new sail boats and readily adapted to existing sailboats.

A final object of this invention to be specifically enumerated herein is to provide a sailboat mast in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a side elevational view of a sailboat utilizing the mast construction of the instant invention and with the mast in a fully stepped position;

FIG. 2 is a side elevational view similar to FIG. 1 but with the mast in a partially unstepped position;

FIG. 3 is a side elevational view of the sailboat with the mast in a fully unstepped position and with a further lowered position thereof illustrated in phantom lines;

FIG. 7 is a fragmentary vertical sectional view taken substantially upon a plane indicated by the section line 7—7 of FIG. 5;

DETAILED DESCRIPTION OF THE INVENTION

Figure 4:
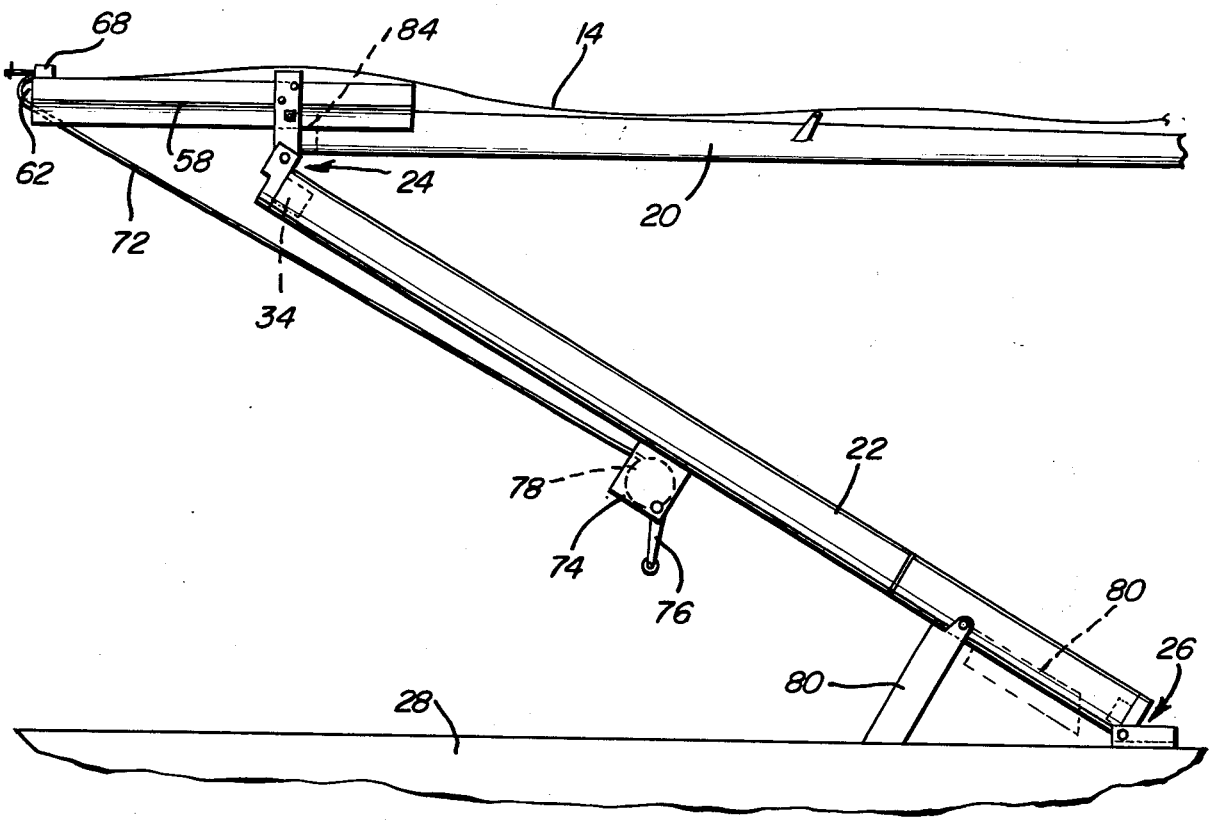
FIG. 4 is an enlarged fragmentary side elevational view of the sailboat with the mast in a fully unstepped position.
Figure 6:
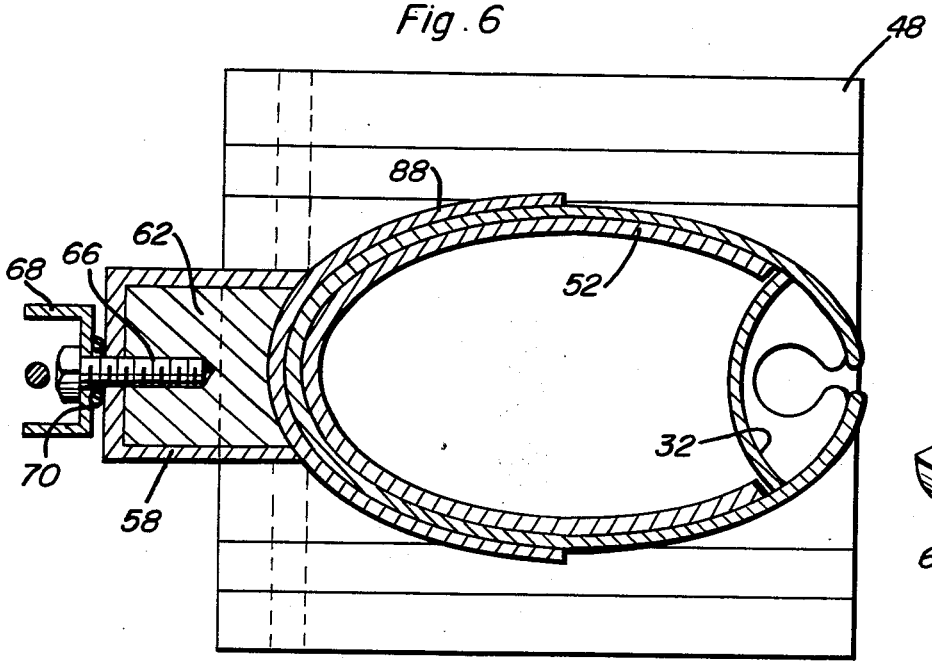
FIG. 6 is an enlarged fragmentary horizontal sectional view taken substantially upon a plane passing through the free end of the lower lever arm portion of the upper mast end portion to which the free end of the winch cable is attached.
Figure 10:
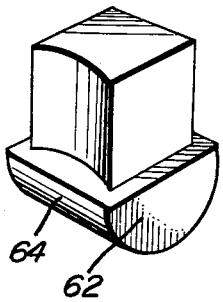
FIG. 10 is a perspective view of the end plug for the free end of the lever arm carried by the lower end of the upper mast section.
Figure 5:
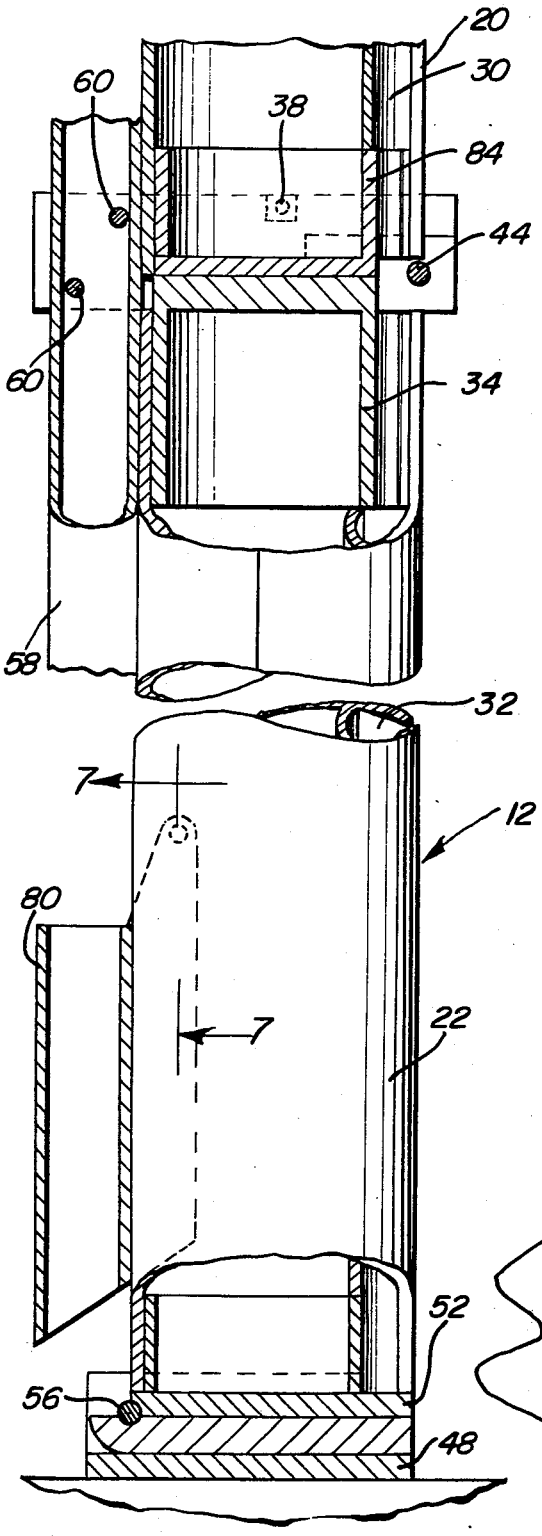
FIG. 5 is a fragmentary enlarged side elevational view of the mast construction with portions thereof being broken away and illustrated in vertical section.
Figure 8:
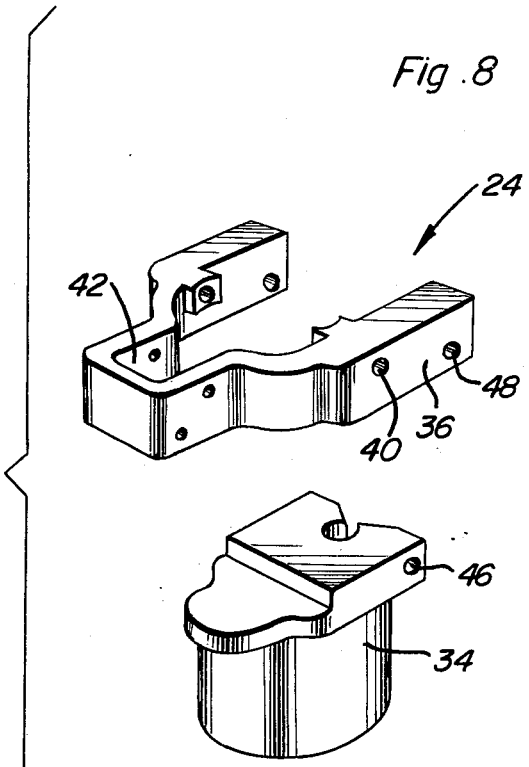
FIG. 8 is an exploded perspective view of the hinge construction by which the lower end of the upper mast section and the upper end of the lower mast section as pivotally joined together.
Figure 9:
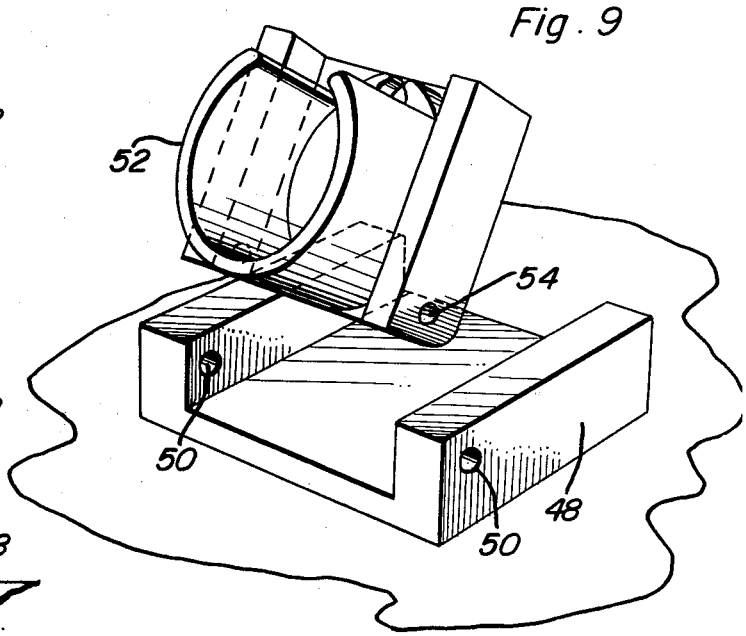
FIG. 9 is an exploded perspective view of the hinge construction by which the lower mast section is pivotally supported from the hull of the sailboat.

Referring now more specifically to the drawings, the numeral 10 generally designates a conventional form of cruising sailboat. The sailboat 10 includes a mast construction in accordance with the present invention referred to in general by the reference numeral 12 and the mast construction 12 includes a forestay 14 and an aft stay 16. In addition, the mast construction 12 may include port and starboard shrouds 18.

The mast construction 12 includes upper and lower sections 20 and 22 with a hinge construction referred to in general by the reference numeral 24 pivotally attaching the lower and upper ends of the upper and lower sections, respectively, and a hinge construction referred to in general by the reference numeral 26 pivotally supporting the lower end of the lower section from the hull 28 of the sailboat 10.

The upper and lower sections 20 and 22 are tubular and include tracks 30 and 32 for receiving followers attached to the sail (not shown) to be raised and lowered along the mast construction 12.

The upper hinge construction 24 includes an end plug 34 for the upper end of the lower section 22 and a frame 36 attached to the lower end of the upper section 20. The frame 36 is attached to the lower end of the upper section 20 by means of fasteners 38 secured through bores 40 in the frame 36 and the latter includes a recess 42 for a purpose to be hereinafter more fully set forth. A pivot pin 44 is removably secured through aligned bores 46 and 48 formed in the end plug 34 and the frame 36 for pivotally attaching the lower end of the upper section 20 to the upper end of the lower section 22.

The hull 28 has a base 48 anchored thereto in any convenient manner and provided with transverse bores 50 and the lower end of the lower section 22 has a lower end plug 52 secured therein including transverse bores 54. A pivot pin 56 is removably passed through the aligned bores 50 and 54 in order to pivotally secure the lower end of the lower section 22 to the hull 28.

The lower end of the upper section 20 includes a lever arm 58 extending therealong and the upper end of the lever arm 58 is secured within the recess 42 by means of suitable fasteners 60. The lever arm 58 extends downwardly below the lower end of the upper section 20 and has a plug 62 secured in its tubular end. The plug 62 includes a lower downwardly convex and transversely extending semi-cylindrical surface 64 and the plug 62 is secured in the lower end of the lever arm 58 by means of a fastener 66 also serving to attach a clip 68 to the lower end of the lever arm 58 and to also anchor an eye splice 70 formed in the free end of a cable 72 to the lower end of the lever arm 58.

A manual winch assembly is mounted on the lower section 22 and includes a crank 76 operatively connected to a winding drum 78 upon which the end of the cable 72 remote from the eye splice 70 is wound. Further, the lower end portion of section 22 of the mast construction 12 includes a pivotally mounted foot 80 which may be swung from the inoperative phantom line position thereof illustrated in FIG. 4 to the operative solid line position thereof illustrated in FIG. 4 with the free end of the foot 80 engaged with the hull 28 and limiting downward swinging movement of the lower section 22 to a position with the lower section 22 inclined forwardly and upwardly approximately 30 degrees from the horizontal.

With attention now invited more specifically to FIGS. 1, 2 and 3 of the drawings, when it is desired to unstep the mast construction 12, the associated sail is lowered and manual forward pressure is applied at the hinge construction 24 to initially "break" the mast construction 12. When the mast construction 12 is fully stepped in the manner illustrated in FIG. 1 of the drawings, the fore and aft stays 14 and 16 tend to lock the mast construction 12 in its upright position, although any suitable latch means (not shown) may be included for latching the lower end of the lever arm 58 to the lower section 22.

In any event, after the mast construction 12 has been initially forwardly "broken" at the hinge construction 24, the additional tension on the cable 72 will prevent further "breaking" of the mast construction 24 and the aft stay 16 will prevent the upper end of the upper section 20 from swinging forward. Thereafter, the winch construction 74 may be actuated to controllably unwind the cable 72 from the winding drum 78 thereof with the result that the lower section 22 will be swung from the position thereof illustrated in FIG. 2 to the position thereof illustrated in FIGS. 3 and 4. During this time the aft stay 16 will maintain the upper section 20 substantially fully upright.

After the cable 72 (which passes over the surface 64) has been unwound from the winding member or drum 78 sufficient to lower the lower section 22 to the position thereof illustrated in FIGS. 3 and 4 with the foot 80 engaged with the hull 28 in order to prevent further lowering of the lower section 22, further unwinding of the cable 72 from the winding member or drum 78 will allow the upper section 20 to swing rearwardly at its upper end from a substantially upright position to the substantially horizontal position thereof illustrated in FIGS. 3 and 4. At this point, the free end of the upper section 20 remote from the section 22 may be propped by means of a crutch 82, or the like, see FIG. 3.

After the mast construction 12 has been unstepped to the position thereof illustrated in solid lines in FIG. 3, the sailboat 10 may readily pass under low bridges. Immediately after the low bridge has been passed, the winch 74 may be actuated to wind the cable 72 onto the winding member 78 to cause the upper section 20 to be initially raised to the upright position and to thereafter cause the lower section 22 to be swung from the solid line position thereof illustrated in FIGS. 3 and 4 to the upright position thereof illustrated in FIG. 1. The aft shroud 16 coacts with the winch assembly 74 and the cable 72 to insure the aforementioned sequential movements of the upper and lower sections 20 and 22 as the mast construction 12 is unstepped and stepped. Inasmuch as the mast construction 12 is repeatedly stepped in the identical position, retuning of the shrouds 18 and the fore and aft stays 14 and 16 is not required. Further, after the mast construction 12 has been "broken" to the position thereof illustrated in FIG. 2, the forestay 14 may be releasably engaged with the clip 68. In addition, suitable means may be utilized to temporarily secure the aft stay 16 and the shrouds 18 after the mast construction 12 has been fully unstepped to the position thereof illustrated in FIG. 3.

If it is desired to vertically stack the saiboat 10 as is customarily practiced when providing "high rise" storage for power boats, after the mast construction 12 has been lowered to the positions thereof illustrated in solid lines in FIGS. 3 and 4 of the drawings, the cable 72 may be further unwound from the winding member 78 and the person unstepping the mast construction 12 may thereafter slightly lift the upper end of the lower section 22 and swing the foot 80 to the inoperative phantom line position thereof illustrated in FIG. 4 and thereafter manually lower the lower section 22 to the position thereof illustrated in phantom lines in FIG. 3. Of course, while the lower section 22 is being manually lowered to the phantom line position thereof illustrated in FIG. 3, the free end of the upper section 20 may remain supported from the crutch 82 and thereafter lowered to the phantom line position thereof illustrated in FIG. 3 and resupported by a shorter crutch or the same curtch 82 if the latter is of the telescopic type.

When it is desired to step the mast construction 12 from the phantom line position thereof illustrated in FIG. 3, the free end of the upper section 20 is first propped in elevated position and the section 22 is thereafter lifted to a position slightly above that illustrated in solid lines in FIGS. 3 and 4 and the foot 80 is swung from the inoperative phantom line position of FIG. 4 to the solid line operative position of FIG. 4. Thereafter, the winch assembly 74 may be actuated to wind the cable 72 onto the winding member 78 whereby the upper section 20 will be first raised to the upstanding position and the resultant tensioning of the aft stay 16 will thereafter allow further tensioning of the cable 72 to swing the lower section 22 to the upstanding position. As hereinbefore set forth, the stays 14 and 16 serve to lock the mast construction 12 in the fully stepped position thereof as do the shrouds 18. However, if it is desired, a latch may be provided for latching the free end of the lever arm 58 to the lower most section 22 when the mast construction 12 is fully stepped.

From the foregoing, it is believed obvious that a single person may quickly and easily unstep and step the mast construction 12 and that the boat 10 may therefore be readily prepared for trailering, passing under low bridges and storage by "high rise" storage methods.

It will be noted that the lower end of the upper section 20 also includes an end plug 84 corresponding to the end plug 34 and each of the end plugs 34, 52 and 84 includes a passage therethrough communicated with the adjacent ends of the tracks 30 and 32.

The lever 58 includes an integral rearwardly opening seat portion 88 in which the forward portion of the upper section 20 is seated and in which the forward portion of the upper end of the section 22 is embracingly receivable.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A sailboat including a hull, an upright mast, said mast including upper and lower end portions, first means pivotally supporting the lower end of said lower end portion from said hull for swinging between an upright position and a lowered position with the upper end of said lower end portion swung toward one end of said hull, second means pivotally supporting the lower end of said upper end portion from the upper end of said lower end portion for swinging between an upright position and a lowered position with the upper end of said upper end portion swung toward the other end of said hull, amd third means operatively connected between said upper and lower end portions and said hull operative for sequentially controllably lower said lower end portion from its upright position to its lowered position while maintaining said upper end portion upright and thereafter controllably lower said upper end portion from its upright position to its lowered position and for sequentially controllably raising said upper end portion from its lowered position to an upright position and thereafter controllably raise said lower end portion from its lowered position to its upright position while maintaining said upper end portion upright.

2. The combination of claim 1 wherein said mast sections and said second means include coacting means defining a continuous track extending along one side of said mast for guidingly receiving said attached followers.

3. The combination of claim 1 wherein said mast upper and lower end portions include tubular adjacent ends, said second means including end plugs secured in said adjacent ends for reinforcing the latter.

4. The combination of claim 1 wherein said lowered position of said lower end portion comprises a position with said lower end portion inclined between 20 and 40 degrees relative to the horizontal and said lower end portion includes a prop intermediate its opposite ends engageable with said hull to prevent further lowering of said lower end portion.

5. The combination of claim 4 wherein said prop is supported from said lower end portion for shifting between operative and inoperative positions, whereby said lower end portion may be manually lowered below said lowered position upon shifting of said prop to said inoperative position.

6. The combination of claim 1 wherein third means includes force means for controlling relative angular displacement between said upper and lower end portions of said mast and an inclined flexible mast stay anchored at its upper end to the upper end of said upper end portion of said mast and at its lower end to said hull at a position spaced along said hull toward said other end thereof from said mast.

7. The combination of claim 6 wherein said mast sections and said second means include coacting means defining a continuous track extending along one side of said mast for quidingly receiving said attached followers.

8. The combination of claim 7 wherein said mast upper and lower end portions include tubular adjacent ends, said second means including end plugs secured in said adjacent ends for reinforcing the latter.

9. The combination of claim 6 wherein said lowered position of said lower end portion comprises a position with said lower end portion inclined between 20 and 40 degrees relative to the horizontal and said lower end portion includes a prop intermediate its opposite ends engageable with said hull to prevent further lowering of said lower end portion.

10. The combination of claim 9 wherein said prop is supported from said lower end portion for shifting between operative and inoperative positions, whereby said lower end portion may be manually lowered below said lowered position upon shifting of said prop to said inoperative position.

* * * * *